US011279512B2

(12) United States Patent
Fujita

(10) Patent No.: US 11,279,512 B2
(45) Date of Patent: Mar. 22, 2022

(54) SHEET PASTING DEVICE AND SHEET PASTING METHOD

(71) Applicant: LINTEC CORPORATION, Tokyo (JP)

(72) Inventor: Toshihiro Fujita, Tokyo (JP)

(73) Assignee: LINTEC CORPORATION, Tokyo (JP)

( * ) Notice: Subject to any disclaimer, the term of this patent is extended or adjusted under 35 U.S.C. 154(b) by 0 days.

(21) Appl. No.: 17/072,878

(22) Filed: Oct. 16, 2020

(65) Prior Publication Data

US 2021/0031961 A1 Feb. 4, 2021

Related U.S. Application Data

(63) Continuation of application No. PCT/JP2019/012688, filed on Mar. 26, 2019.

(30) Foreign Application Priority Data

May 8, 2018 (JP) ..... JP2018-090141

(51) Int. Cl.
*B65C 9/32* (2006.01)
*B65C 9/42* (2006.01)

(52) U.S. Cl.
CPC . *B65C 9/32* (2013.01); *B65C 9/42* (2013.01)

(58) Field of Classification Search
CPC .... B65C 9/32; B65C 9/42; B65C 9/40; B65C 2009/401; B65C 1/021
See application file for complete search history.

(56) References Cited

U.S. PATENT DOCUMENTS 6,655,436 B1 12/2003 Venditti et al.
9,802,728 B1 * 10/2017 Rodgers ..... B65C 1/021
2010/0200159 A1 * 8/2010 Le ..... B65C 1/021 156/277

(Continued)

FOREIGN PATENT DOCUMENTS

JP H0699957 A 4/1994
JP H0880925 A 3/1996
JP H09240641 A 9/1997

(Continued)

OTHER PUBLICATIONS

International Search Report (ISR) (and English translation thereof) dated May 28, 2019 issued in International Application No. PCT/JP2019/012688.

(Continued)

*Primary Examiner* — George R Koch
(74) *Attorney, Agent, or Firm* — Holtz, Holtz & Volek PC

(57) ABSTRACT

A sheet pasting device EA which pastes an adhesive sheet AS on a work WK includes: a feeding unit 10 which feeds the adhesive sheet AS; a holding unit 20 which holds the adhesive sheet AS fed by the feeding unit 10, on a holding surface 21A of a holding member 21; a press unit 30 which moves the holding unit 20 holding the adhesive sheet AS and presses the adhesive sheet AS against an attachment surface WK1 of the work WK to paste the adhesive sheet AS; and an attachment surface posture detecting unit 40 which detects at least one of the direction and the position of the attachment surface WK1 of the work WK moving relative to the sheet pasting device EA.

5 Claims, 2 Drawing Sheets

(56) References Cited

U.S. PATENT DOCUMENTS

| | | | |
|---|---|---|---|
| 2016/0362583 | A1 | 12/2016 | Naik et al. |
| 2018/0022966 | A1 | 1/2018 | Naik et al. |

FOREIGN PATENT DOCUMENTS

| | | | |
|---|---|---|---|
| JP | 2002019754 | A | 1/2002 |
| JP | 2002362524 | A | 12/2002 |
| JP | 2005022676 | A | 1/2005 |
| JP | 2006143234 | A | 6/2006 |

OTHER PUBLICATIONS

Written Opinion dated May 28, 2019 issued in International Application PCT/JP2018/012688.

* cited by examiner

SHEET PASTING DEVICE AND SHEET PASTING METHOD

This application is a continuation of PCT/JP2019/012688, filing date Mar. 26, 2019.

BACKGROUND OF THE INVENTION

Field of the Invention

The present invention relates to a sheet pasting device and a sheet pasting method, and for example, relates to a device and a method for pasting an adhesive sheet-like one on a work such as a semiconductor wafer.

Description of the Related Art

Examples of a sheet pasting device include a device that holds, with a holding unit, an adhesive sheet fed by a feeding unit and pastes the held adhesive sheet on a work. To accurately paste the label on an attachment surface of the work, this device causes the holding unit to once stop carrying the work and pastes the label on the stopping work.

SUMMARY OF THE INVENTION

The present invention disclosed and claimed herein, in one aspect thereof, comprises a sheet pasting device. The device comprises:

a feeding unit which feeds an adhesive sheet;

a holding unit which holds the adhesive sheet fed by the feeding unit, on a holding surface of a holding member;

an attachment surface posture detecting unit which detects at least one of a direction and a position of the attachment surface of the work moving relative to the sheet pasting device; and a press unit which moves the holding unit holding the adhesive sheet and presses the adhesive sheet against the attachment surface of the work to paste the adhesive sheet, wherein the press unit makes the holding member move following the work moving relative to the sheet pasting device, based on a result of the detection by the attachment surface posture detecting unit so as to be capable of pressing the adhesive sheet with the holding surface oriented in a predetermined direction relative to the attachment surface, so as to be capable of pressing the adhesive sheet with the holding surface located at a predetermined position relative to the attachment surface, or so as to be capable of pasting the adhesive sheet with the holding surface oriented in the predetermined direction relative to the attachment surface and so as to be capable of pressing the adhesive sheet with the holding surface located at the predetermined position relative to the attachment surface.

Further scope of applicability of the present invention will become apparent from the detailed description given hereinafter. The detailed description and embodiments are only given as examples though showing preferred embodiments of the present invention, and therefore, from the contents of the following detailed description, changes and modifications of various kinds within the spirits and scope of the invention will become apparent to those skilled in the art.

BRIEF DESCRIPTION OF THE DRAWINGS

The present invention will be fully understood from the following detailed description and the accompanying drawings. The accompanying drawings only show examples and are not intended to restrict the present invention. In the accompanying drawings.

DETAILED DESCRIPTION

Figure 1A:
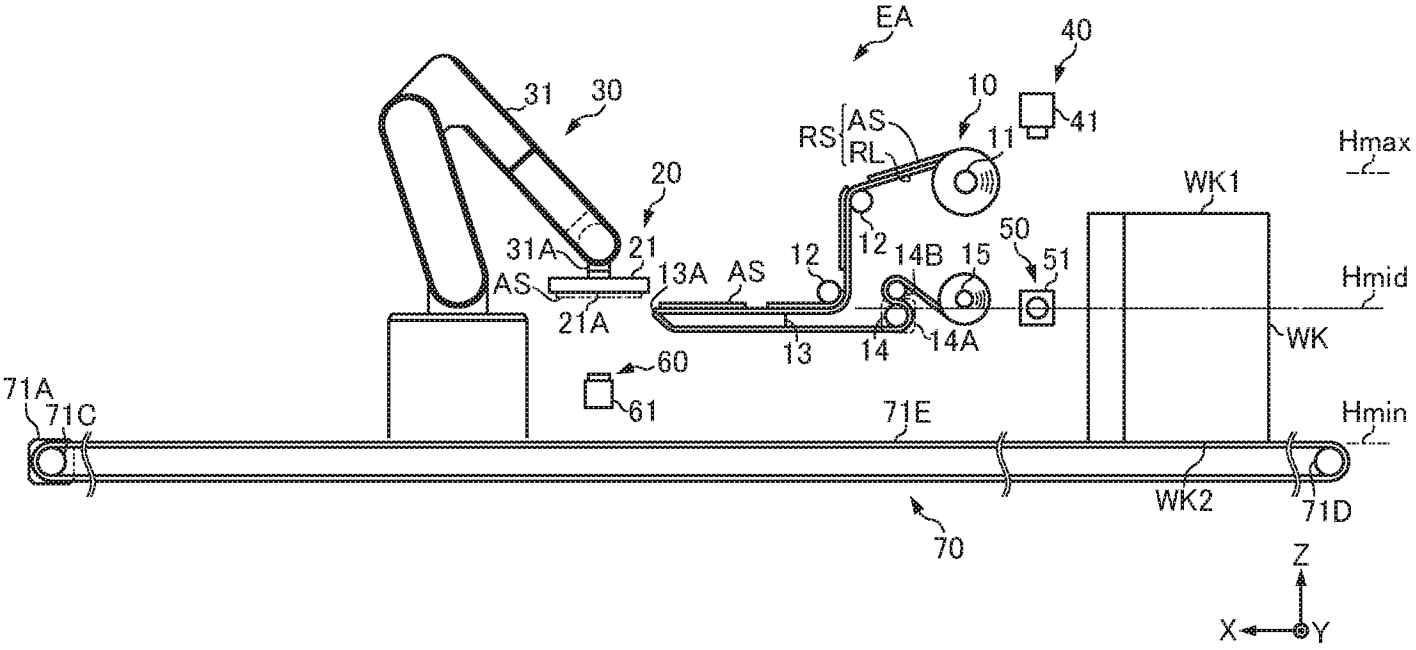
FIG. 1A is an explanatory view of a sheet pasting device according to one embodiment.

An embodiment will be hereinafter described with reference to the drawings.

It should be noted that X-axis, Y-axis, and Z-axis in the embodiment are orthogonal to one another, where the X-axis and Y-axis are within a predetermined plane while the Z-axis is orthogonal to the predetermined plane. Further, in the embodiment, FIG. 1A as viewed from the near side in terms of the direction parallel to the Y-axis is used as a reference for direction, and when a direction is mentioned without any designation of a drawing, an "upper" direction means a direction indicated by an arrow along the Z-axis, a "lower" direction means a direction opposite the upper direction, a "left" direction means a direction indicated by an arrow along the X-axis, a "right" direction means a direction opposite the "left" direction, a "front" direction means a direction toward the near side in FIG. 1A in terms of a direction parallel to the Y-axis, and a "rear" direction means a direction opposite the "front" direction.

A sheet pasting device EA pastes an adhesive sheet AS on a work WK and includes: a feeding unit 10 which feeds the adhesive sheet AS; a holding unit 20 which holds the adhesive sheet AS fed by the feeding unit 10, on a holding surface 21A of a holding member 21; a press unit 30 which moves the holding unit 20 holding the adhesive sheet AS and presses the adhesive sheet AS against an attachment surface WK1 of the work WK to paste the adhesive sheet AS; an attachment surface posture detecting unit 40 which detects both the direction and the position of the attachment surface WK1 of the work WK moving relative to the sheet pasting device EA; a height detecting unit 50 which detects the height of the attachment surface WK1; and a sheet posture detecting unit 60 which detects both the direction and the position of the adhesive sheet AS held on the holding surface 21A of the holding member 21. The sheet pasting device EA is disposed above a carrier unit 70 which carries the work WK.

In this embodiment, depending on each work WK, the position of the attachment surface WK1 differs within a range between the minimum value Hmin and the maximum value Hmax in the up-down direction as a height direction orthogonal to an installation surface WK2 of the work WK. Further, in the state in FIG. 1A, the attachment surface WK1 of the work WK, the adhesive sheet AS, and the holding surface 21A of the holding member 21 in this embodiment are all rectangular in a top view.

The feeding unit 10 includes: a support roller 11 which supports a raw sheet RS in which the adhesive sheet AS is temporarily bonded on one surface of a band-shaped release liner RL; guide rollers 12 which guide the raw sheet RS; a releasing plate 13 as a releasing unit which releases the adhesive sheet AS from the release liner RL; a drive roller 14 which is supported by a not-illustrated output shaft of a rotary motor 14A as a drive device and sandwiches the release liner RL between itself and a pinch roller 14B; and a recovering roller 15 which constantly applies predetermined tension to the release liner RL present between itself and the pinch roller 14B and recovers the release liner RL.

The feeding unit 10 of this embodiment feeds the adhesive sheet AS to the same height position as a middle Hmid between the minimum value Hmin and the maximum value Hmax in the height direction of the work WK.

The holding unit 20 includes a holding member 21 having a holding surface 21A on which the adhesive sheet AS can be held by being sucked by a not-illustrated pressure-reducing unit such as a pressure-reducing pump or a vacuum ejector.

The press unit 30 includes: what is called a multi joint robot 31 as a drive device composed of a plurality of arms, supporting the holding unit 20 at its tip arm 31A, which is a working part, and capable of displacing the holding unit 20 to any position or any angle in its work range WA; and a not-illustrated pressurizing unit such as a pressurizing pump or a turbine which ejects gas from the holding surface 21A of the holding member 21. The multi-joint robot 31 is capable of moving the holding surface 21A of the holding member 21 in the X-axis direction, the Y-axis direction, the Z-axis direction, or any direction including these components in its work range WA and is also capable of rotating the holding surface 21A of the holding member 21 around an axis parallel to the X-axis, an axis parallel to the Y-axis, an axis parallel to the Z-axis, or any direction axis including these components.

The press unit 30 is capable of pasting the adhesive sheet AS on the attachment surface WK1 based on the detection result of the height detecting unit 50.

The attachment surface posture detecting unit 40 is disposed above the carrier unit 70 and includes an attachment surface posture detector 41 composed of an imaging unit such as a camera or a projector, various sensors such as an optical sensor and an ultrasonic sensor, and so on.

The height detecting unit 50 is disposed at the back of the carrier unit 70 and includes a height detector 51 composed of an imaging unit such as a camera or a projector, various sensors such as an optical sensor and an ultrasonic sensor, and so on.

The sheet posture detecting unit 60 is disposed on the left of and below the releasing plate 13 and includes a sheet detector 61 composed of an imaging unit such as a camera or a projector, various sensors such as an optical sensor and an ultrasonic sensor, and so on.

The carrier unit 70 includes a drive roller 71C supported by an output shaft 71B of a rotary motor 71A as a drive device, a driven roller 71D capable of freely rotating, and an endless belt 71E wound around the drive roller 71C and the driven roller 71D.

The operation of the above-described sheet pasting device EA will be described.

First, in the sheet pasting device EA whose members are arranged at initial positions indicated by the solid lines in FIG. 1A, a user of the sheet pasting device EA (hereinafter, referred to simply as a "user") sets the raw sheet RS as illustrated in FIG. 1A, and thereafter inputs an automatic operation start signal through a not-illustrated operation unit such as an operation panel or a personal computer. Then, the feeding unit 10 drives the rotary motor 14A to feed out the raw sheet RS, and when a feeding-direction leading end portion of the adhesive sheet AS at the head reaches a predetermined position near the releasing edge 13A above the releasing plate 13, the feeding unit 10 stops driving the rotary motor 14A, and thereafter the carrier unit 70 drives the rotary motor 71A to rotate the endless belt 71E.

Next, when the user or a not-illustrated loading unit such as a multi-joint robot or a drive device places the work WK on the endless belt 71E, the work WK is carried leftward. Thereafter, when the work WK reaches a detection area of the attachment surface posture detector 41, the attachment surface posture detecting unit 40 drives the attachment surface posture detector 41 to capture an image of the attachment surface WK1. At this time, from the captured image, the attachment surface posture detecting unit 40 specifies, for example, the positions of the four corners of the attachment surface WK1, finds the lengths, directions, positions, and so on of the long sides, short sides, and diagonal lines of the attachment surface WK1, and calculates the direction of an attachment surface center line WKL, which is a straight line passing through the middles of the short sides of the attachment surface WK1 and is a center line of the attachment surface WK1, and the position of an attachment surface center point WKC, which is an intersection of the diagonal lines of the attachment surface WK1 and is a center point of the attachment surface WK1. Then, from the results of the above calculation, the attachment surface posture detecting unit 40 finds an inclination θ1 of the attachment surface center line WKL relative to a carrying direction TD of the carrier unit 70 (X-axis direction), and detects the direction of the attachment surface WK1 of the work WK moving relative to the sheet pasting device EA. Further, from the results of the above calculation, the attachment surface posture detecting unit 40 finds at which coordinate position in an XY plane the attachment surface center point WKC is at an instant when the image is captured, relative to a robot center point 31C which is the center of the multi-joint robot 31 in the XY plane, and detects the position of the attachment surface WK1 of the work WK moving relative to the sheet pasting device EA.

The attachment surface posture detecting unit 40 may have pre-stored various pieces of information for use in the detection of the direction and the position of the attachment surface WK1 carried by the carrier unit 70, such as the carrying direction TD of the carrier unit 70, the position of the robot center point 31C, and the carrying speed and the carrying position of the carrier unit 70, or may detect or calculate these pieces of information.

Next, when the work WK reaches a detection area of the height detector 51, the height detecting unit 50 drives the height detector 51 to detect the height position of the attachment surface WK1. Thereafter, the carrier unit 70 still continues to carry the work WK, and when the work WK reaches a predetermined position, the feeding unit 10 and the holding unit 20 drive the rotary motor 14A and the not-illustrated pressure-reducing unit, and the raw sheet RS is fed out. Consequently, the adhesive sheet AS is released from the release liner RL at the releasing edge 13A of the releasing plate 13, and as indicated by the two-dot chain line in FIG. 1A, the adhesive sheet AS is suction-held on the holding surface 21A of the holding member 21. When a feeding-direction leading end portion of the next adhesive sheet AS reaches the predetermined position near the releasing edge 13A above the releasing plate 13, the feeding unit 10 stops driving the rotary motor 14A.

When the adhesive sheet AS is suction-held on the holding surface 21A, the sheet posture detecting unit 60 drives the sheet detector 61 to capture an image of the adhesive sheet AS held on the holding surface 21A. At this time, from the captured image, the sheet posture detecting unit 60 specifies, for example, the positions of the four corners of the adhesive sheet AS held on the holding surface 21A, finds the lengths, directions, positions, and so on of the long sides, short sides, and diagonal lines of the adhesive sheet AS, and calculates the direction of an adhesive sheet center line ASL, which is a straight line passing through the middles of the short sides of the adhesive sheet AS and is a center line of the adhesive sheet AS, and the position of an adhesive sheet center point ASC which is an intersection of the diagonal lines of the adhesive sheet AS and is a center point of the adhesive sheet AS. Then, from the results of the above calculation, the sheet posture detecting unit 60 finds an inclination θ2 of the adhesive sheet center line ASL relative to a holding surface center line 21L which is a straight line passing through the middles of the short sides of the holding surface 21A and is a center line of the holding surface 21A, and detects the direction of the adhesive sheet AS held on the holding surface 21A. Further, from the results of the above calculation, the sheet posture detecting unit 60 finds the coordinate position of the adhesive sheet center point ASC in the holding surface 21A relative to a holding surface center point 21C which is an intersection of the diagonal lines of the holding surface 21A and is a center point of the holding surface 21A, and detects the position of the adhesive sheet AS held on the holding surface 21A.

The sheet posture detecting unit 60 may have pre-stored various pieces of information for use in the detection of the direction and the position of the adhesive sheet AS held on the holding surface 21A, such as the directions and positions of the long sides, short sides, and diagonal lines of the holding surface 21A, the direction and the position of the holding surface center line 21L, and the position of the holding surface center point 21C, or may detect or calculate these pieces of information.

Thereafter, the carrier unit 70 still continues to carry the work WK, and when the work WK reaches the inside of the work range WA of the multi-joint robot 31, the press unit 30 performs the following pasting operation.

Figure 1B:
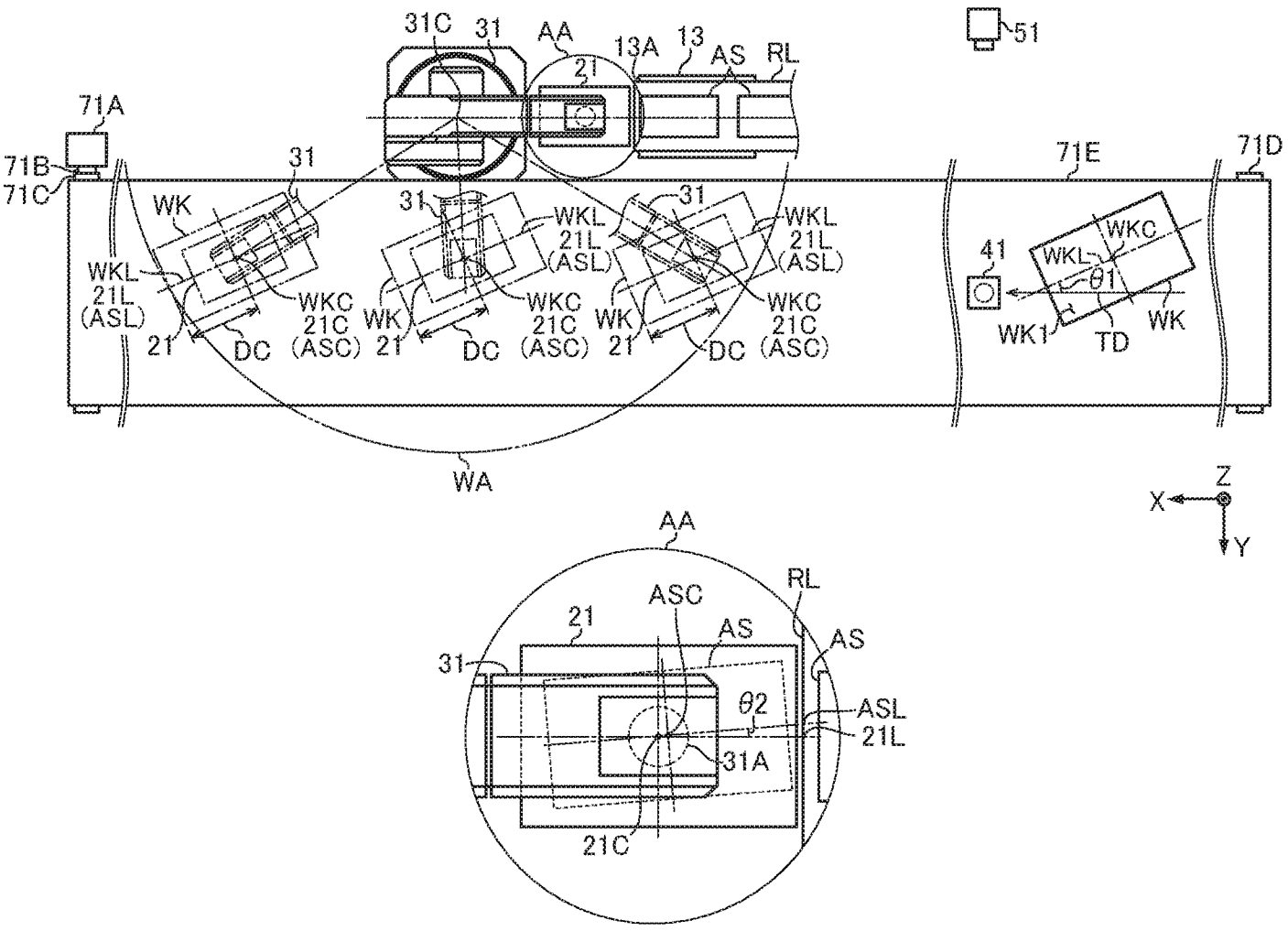
FIG. 1B is an explanatory view of the sheet pasting device according to the embodiment.

Specifically, the press unit 30 drives the multi-joint robot 31 to move the holding member 21 in the carrying direction TD in pace with the carrying speed of the work WK while keeping the adhesive sheet AS held on the holding surface 21A away from the attachment surface WK1 by a predetermined distance (for example, 10 mm) based on the height position of the attachment surface WK1 detected by the height detecting unit 50. During this period, as indicated by the two-dot chain lines in FIG. 1B, the press unit 30 makes the holding member 21 move following the work WK moving relative to the sheet pasting device EA, based on the detection result of the attachment surface posture detecting unit 40 so as to be capable of pressing the adhesive sheet AS with the holding surface 21A oriented in a predetermined direction relative to the attachment surface WK1 and so as to be capable of pressing the adhesive sheet AS with the holding surface 21A located at a predetermined position relative to the attachment surface WK1.

In this embodiment, the press unit 30 corrects the position of the holding member 21 which is moved following the work WK, based on the detection result of the sheet posture detecting unit 60 so as to be capable of bonding the adhesive sheet AS with the adhesive sheet AS oriented in a predetermined direction relative to the attachment surface WK1 and with the adhesive sheet AS located at a predetermined position relative to the attachment surface WK1.

Specifically, the press unit 30 drives the multi-joint robot 31 and moves the holding member 21 while keeping the attachment surface center line WKL and the adhesive sheet center line ASL coinciding with each other in the top view, thereby capable of bonding the adhesive sheet AS with the adhesive sheet AS oriented in the predetermined direction relative to the attachment surface WK1 Further, the press unit 30 drives the multi-joint robot 31 and moves the holding member 21 while keeping the adhesive sheet center point ASC located at a position apart from the position of the downstream short side of the attachment surface WK1 in terms of the carrying direction TD by a distance DC in the top view, thereby capable of bonding the adhesive sheet AS with the adhesive sheet AS located at the predetermined position relative to the attachment surface WK1. Note that the distance DC is preferably a half or more of the length of the long side of the adhesive sheet AS, but may be a half or less of the long side of the adhesive sheet AS, and a user can decide it as desired.

While the holding member 21 is moved as above, the holding unit 20 stops driving the not-illustrated pressure-reducing unit and at the same time, the press unit 30 drives the not-illustrated pressurizing unit and presses the adhesive sheet AS against the work WK by ejecting the gas from the holding surface 21A to paste the adhesive sheet AS, and thereafter, the press unit 30 drives the multi-joint robot 31 to return the holding member 21 to the initial position. The timing when the press unit 30 presses the adhesive sheet AS against the work WK to paste the adhesive sheet AS may be any as long as it is the timing when the work WK is in the work range WA of the multi-joint robot 31. Thereafter, the carrier unit 70 still continues to carry the work WK, and when the work WK on which the adhesive sheet AS is pasted reaches a predetermined position, the user or a not-illustrated unloading unit such as a multi-joint robot or a drive device picks up the work WK from the carrier unit 70 to carry it to another process, and the same operation as above is repeated thereafter.

According to the above-described embodiment, since the holding member 21 holding the adhesive sheet AS is moved following the work WK moving relative to the sheet pasting device EA, it is possible to paste the adhesive sheet AS on the work WK without once stopping the carriage of the work WK, making it possible to prevent sheet pasting performance from lowering.

The invention is by no means limited to the above units and processes as long as the above operations, functions, or processes of the units and processes are achievable, still less to the above merely exemplary structures and processes described in the exemplary embodiment. For instance, the feeding unit may be any feeding unit within the technical scope in light of the common general technical knowledge at the time of the filing of the application as long as it is capable of feeding the adhesive sheet (the same applies to other units and steps).

The feeding unit 10 may feed out a raw sheet in which incisions are formed in a closed-loop shape or along the entire short width direction in a band-shaped adhesive sheet base temporarily bonded to the release liner RL and a predetermined area demarcated by the incisions is the adhesive sheet AS. In a case where a raw sheet in which a band-shaped adhesive sheet base is temporarily bonded to the release liner RL is adopted, a cutting unit may make incisions in a closed-loop shape or along the entire short width direction in the adhesive sheet base to form a predetermined area demarcated by the incisions as the adhesive sheet AS. At the time of the release of the adhesive sheet AS from the release liner RL, the torque of the rotary motor 14A may be controlled such that predetermined tension is applied to the raw sheet RS. Instead of each of the rollers such as the support roller 11 and the guide rollers 12, a plate-shaped member, a shaft member, or the like may support or guide the raw sheet RS or the release liner RL, and the raw sheet RS may be supported in a fan-folded state instead of in the wound state. The release liner RL may be recovered in, for example, a fan-folded state or in a state where it is torn by a shredder or the like, instead of in the wound state. The release liner RL does not necessarily have to be recovered. The adhesive sheet AS may be set vertically or obliquely when it is fed. A printer that writes information such as a predetermined character or number on the adhesive sheet AS or prints an image such as a predetermined pattern or picture on the adhesive sheet AS may be provided. The adhesive sheet AS does not necessarily have to be fed to the same height position as the middle Hmid.

In the state in FIG. 1A, the holding surface 21A of the holding unit 20 may be in any shape in the top view, such as a square shape, a circular shape, an elliptical shape, a triangular shape, a polygonal shape having five sides or more, or any other shape.

The press unit 30 may make the holding member 21 move following the work WK moving relative to the sheet pasting device EA, based on the detection result of the attachment surface posture detecting unit 40 so as to be capable of pressing the adhesive sheet AS with the holding surface 21A oriented in the predetermined direction relative to the attachment surface WK1, without specifying the position of the holding surface 21A relative to the attachment surface WK1, or may make the holding member 21 move following the work WK moving relative to the sheet pasting device EA, based on the detection result of the attachment surface posture detecting unit 40 so as to be capable of pressing the adhesive sheet AS with the holding surface 21A located at the predetermined position relative to the attachment surface WK1, without specifying the direction of the holding surface 21A relative to the attachment surface WK1.

The press unit 30 may correct the position of the holding member 21 moved following the work WK, based on the detection result of the sheet posture detecting unit 60 so as to be capable of bonding the adhesive sheet AS with the adhesive sheet AS oriented in the predetermined direction relative to the attachment surface WK1, without specifying the pasting position of the adhesive sheet AS on the attachment surface WK1, or may correct the position of the holding member 21 moved following the work WK, based on the detection result of the sheet posture detecting unit 60 so as to be capable of bonding the adhesive sheet AS with the adhesive sheet AS located at the predetermined position relative to the attachment surface WK1, without specifying the direction of the adhesive sheet AS relative to the attachment surface WK1.

When the press unit 30 moves the holding member 21 in the carrying direction TD in pace with the carrying speed of the work WK, the predetermined distance between the adhesive sheet AS held on the holding surface 21A and the attachment surface WK1 may be 10 mm or less (for example, 5 mm or 1 mm) or may be 10 mm or more (for example, 15 mm or 50 mm).

The press unit 30 may also push the holding member 21 on the work WK to press the adhesive sheet AS against the work WK, thereby pasting the adhesive sheet AS. In this case, when pasting the adhesive sheet AS on the work WK, the press unit 30 may move the holding unit 20 in the direction of the work WK while the work WK is not moved or is moved in the direction of the holding unit 20, or at the time of pasting the adhesive sheet AS on the work WK, the work WK may be moved in the direction of the holding unit 20 without the holding unit 20 being moved in the direction of the work WK. The press unit 30 may include or may be without the not-illustrated pressurizing unit.

The predetermined direction of the adhesive sheet AS set by the press unit 30 relative to the attachment surface WK1 may be, for example, such a direction that one side of the attachment surface WK1 and one side of the adhesive sheet AS become parallel to each other, or may be such a direction that any of the sides of the adhesive sheet AS is not parallel to any of the sides of the attachment surface WK1, and the user can decide it as desired. The predetermined position of the adhesive sheet AS relative to the attachment surface WK1 may be, for example, such a position that the attachment surface center point WKC and the adhesive sheet center point ASC coincide with each other, or may be such a position that one corner of the attachment surface WK1 and one corner of the adhesive sheet AS coincide with each other, and the user can decide it as desired.

The press unit 30 may paste two or more adhesive sheets AS on one attachment surface WK1, may paste a plurality of the same adhesive sheets AS on one attachment surface of one work WK, may paste a plurality of different adhesive sheets AS on one attachment surface of one work, may paste a plurality of the same adhesive sheets AS on a plurality of attachment surfaces of one work WK respectively, and may paste a plurality of different adhesive sheets AS on a plurality of attachment surfaces of one work WK respectively.

The attachment surface posture detecting unit 40 may detect only the direction of the attachment surface WK1, may detect only the position of the attachment surface WK1, may specify, from the captured image, for example, the lengths of the sides and the angles of the four corners of the attachment surface WK1 to detect the direction and the position of the attachment surface WK1, may find, for example, the inclination of the long sides or the short sides of the attachment surface WK1 relative to the carrying direction TD or the inclination of a straight line passing through the middles of the long sides of the attachment surface WK1 relative to the carrying direction TD to detect the direction of the attachment surface WK1, and may find, for example, the coordinate position of one corner or more out of the four corners of the attachment surface WK1 relative to the robot center point 31C to detect the position of the attachment surface WK1. The reference in detecting the direction of the attachment surface WK1 may be other than the carrying direction TD, and for example, may be the Y-axis direction, a specific position of the endless belt 71E, or the like. The reference in detecting the position of the attachment surface WK1 may be other than the robot center point 31, and may be, for example, a position that is found by associating a pulse generated by the rotary motor 71A and a specific position of the endless belt 71E, or the like.

The attachment surface posture detecting unit 40 is capable of detecting the direction and the position of the attachment surface WK1 whatever shape the attachment surface WK1 has, such as a circular shape, an elliptical shape, a triangular shape, a polygonal shape having five sides or more, or any other shape. For example, if the attachment surface WK1 is circular, the attachment surface posture detecting unit 40 may detect the direction and the position of the attachment surface WK1 from its diameter or radius length, circumferential length, chord length, direction, and position, the position of the attachment surface center point WKC which is an intersection of perpendicular bisectors of a plurality of chords and is the center point of the attachment surface WK1, or the like, may detect the direction and the position of the attachment surface WK1 from the position of a character or a figure written on the attachment surface WK1, the position of a notch, a hole, a groove, a projection, or a dent formed in the attachment surface WK1, or the like, or may detect the direction and the position of the attachment surface WK1 by specifying the positions of the four corners, the lengths of the sides and the angles of the four corners of the attachment surface WK1 through the sensing by the various sensors.

The height detecting unit 50 may detect the height of the attachment surface WK1 by capturing an image of the work WK or sensing it with various sensors. The sheet pasting device EA may be one without the height detecting unit 50.

The sheet posture detecting unit 60 may detect only the direction of the adhesive sheet AS held on the holding surface 21A or may detect only the position of the adhesive sheet AS held on the holding surface 21A. From the captured image, the sheet posture detecting unit 60 may specify, for example, the lengths of the sides and the angles of the four corners of the adhesive sheet AS to detect the direction and the position of the adhesive sheet AS, may find, for example, the inclination of the long sides or the short sides of the adhesive sheet AS relative to the holding surface center line 21L or find the inclination of a straight line passing through the middles of the long sides of the adhesive sheet AS relative to the holding surface center line 21L to detect the direction of the adhesive sheet AS held on the holding surface 21A, and may find, for example, the coordinate position of one corner or more out of the four corners of the adhesive sheet AS relative to the holding surface center point 21C to detect the position of the adhesive sheet AS held on the holding surface 21A. The reference in detecting the direction of the adhesive sheet AS held on the holding surface 21A may be other than the holding surface center line 21L, and may be, for example, the long sides or the short sides of the holding surface 21A, or the like. The reference in detecting the position of the adhesive sheet AS held on the holding surface 21A may be other than the position of the holding surface center point 21C, and may be, for example, the position of one corner of the holding surface 21A or the like.

The sheet posture detecting unit 60 is capable of detecting the direction and the position of the adhesive sheet AS whatever shape the adhesive sheet AS has, such as a circular shape, an elliptical shape, a triangular shape, a polygonal shape having five sides or more, or any other shape. For example, if the adhesive sheet AS is circular, the sheet posture detecting unit 60 may detect its diameter or radius length, circumferential length, chord length, direction, and position, the position of the adhesive sheet center point. ASC which is an intersection of perpendicular bisectors of a plurality of chords and is the center point of the adhesive sheet AS, or the like, may detect the direction and the position of the adhesive sheet AS from a character or a figure written on the adhesive sheet AS, a notch, a hole, a groove, a projection, or a dent formed in the adhesive sheet AS, or the like, and may detect only the direction of the adhesive sheet AS, or may detect only the position of the adhesive sheet AS.

The sheet posture detecting unit 60 is capable of storing various pieces of information for specifying the direction and the position of the adhesive sheet AS held on the holding surface 21A whatever shape the holding surface 21A has, such as a circular shape, an elliptical shape, a triangular shape, a polygonal shape having five sides or more, or any other shape. The sheet posture detecting unit 60 is also capable of detecting or measuring these pieces of information when the holding member 21 is disposed at the initial position. For example, if the holding surface 21A is circular, the sheet posture detecting unit 60 may detect its diameter or radius length, circumferential length, chord length, direction, and position, the position of the holding surface center point 21C which is an intersection of perpendicular bisectors of a plurality of chords and is the center point of the holding surface 21A, or the like, or may detect or measure these pieces of information of the holding surface 21A from a character or a figure written on the holding surface 21A, a notch, a hole, a groove, a projection, or a dent, formed in the holding surface 21A, or the like. The sheet pasting device EA may be one without the sheet posture detecting unit 60. If the sheet pasting device EA does not include the sheet posture detecting unit 60, the press unit 30 drives the multi-joint robot 31 to make the holding member 21 move following the attachment surface WK1 of the work WK being carried by the carrying unit 70 while making the attachment surface center line WK1, and the holding surface center line 211, coincide with each other in the top view or disposing the holding surface center point 21C at the position apart from the downstream short side of the attachment surface WK1 in terms of the carrying direction TD by the distance DC in the top view. Next, the holding unit 20 stops driving the not-illustrated pressure-reducing unit and at the same time, the press unit 30 drives the not-illustrated pressurizing unit to eject the gas from the holding surface 21A and presses the adhesive sheet AS against the work WK by the ejected gas to paste the adhesive sheet AS.

The carrier unit 70 may carry the work WK with a direct-acting motor, a multi-joint robot, or the like. The carrying direction TD need not be linear, and may be, for example, curved or folded-line shaped, and it may be any direction in the XY plane, the XZ plane, the YZ plane, or the XYZ space. In a case where another device carries the work WK, the sheet pasting device EA need not include the carrying unit 70.

The sheet pasting device EA may paste the adhesive sheet AS on the work WK with the adhesive sheet AS set upside down or facing sideways.

The work WK may be a plate-shaped member or a spherical body, and its shape may be any, for example, a tetrahedron or a pentahedron such as a triangular pyramid or a quadrangular pyramid, a circular cone, a circular cylinder, or a prism. The attachment surface of such a work WK is not limited to the top surface of the work WK and may be, for example, a left or right surface or a front or rear surface thereof. If a hole is formed through the carrier unit, the attachment surface may be the installation surface WK2.

In the attachment surface WK1, the attachment surface center line may be the straight line passing through the middles of the long sides, or may be the diagonal line.

The attachment surface WK1 may be inclined relative to the XY plane, and may be curved or rugged. In this case, the attachment surface posture detecting unit 40 only needs to be capable of detecting the direction and the position of the attachment surface WK1 three-dimensionally, and based on the result of the three-dimensional detection of the attachment surface WK1 by the attachment surface posture detecting unit 40, the press unit 30 is capable of pressing the holding surface 21A in a predetermined direction and at a predetermined position or to a predetermined position, against the attachment surface WK1 which is relatively moving, thereby capable of pasting the adhesive sheet AS on the attachment surface WK1.

The planar shapes of the attachment surface WK1, the adhesive sheet. AS, and the holding surface 21A may each be a circle, an ellipse, a triangle, a polygon having five sides or more, or any other shape other than the rectangle, and their shapes may be the same or different.

The materials, types, shapes, and so on of the adhesive sheet AS and the work WK in the present invention are not limited. For example, the adhesive sheet AS may be of a pressure-sensitive bonding type or a heat-sensitive bonding type. If the adhesive sheet AS is of the heat-sensitive bonding type, it may be bonded by an appropriate method, for example, by an appropriate heating unit for heating the adhesive sheet AS, such as a coil heater or a heating side of a heat pipe. Further, such an adhesive sheet AS may be, for example, a single-layer adhesive sheet having only an adhesive layer, an adhesive sheet having an intermediate layer between the base and the adhesive layer, a three or more-layer adhesive sheet having a cover layer on the upper surface of the base, or an adhesive sheet such as what is called a double-faced adhesive sheet in which the base can be released from the adhesive layer. The double-faced adhesive sheet may be one having one intermediate layer or more, or may be a single-layer one or a multilayer one not having an intermediate layer. Further, the work WK may be, for example, a single item such as food, a resin container, a semiconductor wafer such as a silicon semiconductor wafer or a compound semiconductor wafer, a circuit board, an information recording substrate such as an optical disk, a glass plate, a steel sheet, pottery, a wood board, or a resin, or may be a composite made up of two of these or more, and it may also be a member, an article, or the like of any form. The adhesive sheet AS may be read as one indicating its function or application, and may be, for example, any sheet, film, tape, or the like such as an information entry label, a decoration label, a protect sheet, a dicing tape, a die attach film, a die bonding tape, or a recording layer forming resin sheet.

The drive device in the above-described embodiment may be an electric machine such as a rotary motor, a direct-acting motor, a linear motor, a uniaxial robot, a multi-joint robot having two joints or three or more joints, an actuator such as an air cylinder, a hydraulic cylinder, a rodless cylinder, or a rotary cylinder, or the like, or may be one in which some of these are directly or indirectly combined.

In the above-described embodiment, in the case where a rotating member such as a roller is used, a drive device that drives the rotation of the rotating member may be provided, and the surface of the rotating member or the rotating member itself may be formed of a deformable member such as rubber or resin or may be formed of a non-deformable member. Another member such as a shaft or a blade that rotates or does not rotate may be adopted instead of the roller. In a case where a presser such as a press unit or a press member such as a press roller or a press head, that presses an object to be pressed is adopted, a member such as a roller, a round bar, a blade member, rubber, resin, or sponge may be adopted or a structure that sprays gaseous substance such as the atmospheric air or gas for pressing may be adopted, instead of or in addition to those exemplified in the above, and the presser may be formed of a deformable member such as rubber or resin or may be formed of a non-deformable member. In a case where a releaser such as a releasing unit or a releasing member such as a releasing plate or a releasing roller, that releases an object to be released is adopted, a member such as a plate-shaped member, a round bar, or a roller may be adopted instead of or in addition to those exemplified above, and the releaser may be formed of a deformable member such as rubber or resin or may be formed of a non-deformable member. In a case where a member such as a support (holding) unit or a support (holding) member, that supports or holds a member to be supported is adopted, the member to be supported may be supported (held) by a gripping unit such as a mechanical chuck or a chuck cylinder, Coulomb force, an adhesive (adhesive sheet, adhesive tape), a tackiness agent (tacky sheet, tacky tape), magnetic force, Bernoulli adsorption, suction/adsorption, a drive device, or the like. In a case where one that cuts a member to be cut or forms an incision or a cutting line in a member to be cut, such as a cutting unit or a cutting member is adopted, one that cuts with a cutter blade, a laser cutter, ion beams, thermal power, heat, water pressure, a heating wire, or the spraying of gas, liquid, or the like may be adopted instead of or in addition to those exemplified above. Further, an appropriate combination of drive devices may move one that cuts the object to be cut at the time of the cutting.

What is claimed is:

1. A sheet pasting device comprising:

a feeder which feeds an adhesive sheet;

a holder which holds the adhesive sheet, fed by the feeder, on a holding surface of a holding member;

an attachment surface posture detector which detects at least one of a direction and a position of an attachment surface of a work moving relative to the sheet pasting device; and a drive device which causes the holding member to follow the work by causing the holding member to move along with the work in a moving direction of the work in pace with a moving speed of the work moving relative to the sheet pasting device, based on a result of the detection by the attachment surface posture detector, and while the holding member is being moved following the work, to press the adhesive sheet against the attachment surface of the work to paste the adhesive sheet thereon with the holding surface being any of (i) oriented in a predetermined direction relative to the attachment surface, (ii) located at a predetermined position relative to the attachment surface, and (iii) oriented in the predetermined direction relative to the attachment surface and located at the predetermined position relative to the attachment surface.

2. The sheet pasting device of claim 1, wherein:

a position of the attachment surface of the work differs for respective different works within a range between a minimum value and a maximum value in a height direction orthogonal to an installation surface of the work, the sheet pasting device further comprises a height detector which detects a height of the attachment surface, the feeder feeds the adhesive sheet to a height position equal to a height of a middle between the minimum value and the maximum value in the height direction of the work, and the drive device pastes the adhesive sheet on the attachment surface based on a result of the detection by the height detector.

3. The sheet pasting device of claim 1, further comprising a sheet posture detector which detects at least one of a direction and a position of the adhesive sheet held on the holding surface of the holding member, wherein the drive device corrects a position of the holding member which is moved following the work in the moving direction of the work, based on a result of the detection by the sheet posture detector, so as to paste the adhesive sheet with the adhesive sheet being any of (i) oriented in the predetermined direction relative to the attachment surface, (ii) located at the predetermined position relative to the attachment surface, and (iii) oriented in the predetermined direction relative to the attachment surface and located at the predetermined position relative to the attachment surface.

4. The sheet pasting device of claim 2, further comprising a sheet posture detector which detects at least one of a direction and a position of the adhesive sheet held on the holding surface of the holding member, wherein the drive device corrects a position of the holding member which is moved following the work in the moving direction of the work, based on a result of the detection by the sheet posture detector, so as to paste the adhesive sheet with the adhesive sheet being any of (i) oriented in the predetermined direction relative to the attachment surface, (ii) located at a predetermined position relative to the attachment surface, and (iii) oriented in the predetermined direction relative to the attachment surface and located at the predetermined position relative to the attachment surface.

5. A sheet pasting method using a sheet pasting device which pastes an adhesive sheet on a work, the method comprising:

feeding the adhesive sheet;

holding the adhesive sheet, fed in the feeding, on a holding surface of a holding member;

detecting at least one of a direction and a position of an attachment surface of the work moving relative to the sheet pasting device; and causing the holding member to follow the work by causing the holding member to move along with the work in a moving direction of the work in pace with a moving speed of the work moving relative to the sheet pasting device, based on a result of the detecting, and while the holding member is being moved following the work, to press the adhesive sheet against the attachment surface of the work to paste the adhesive sheet thereon with the holding surface being any of (i) oriented in a predetermined direction relative to the attachment surface, (ii) located at a predetermined position relative to the attachment surface, and (iii) oriented in the predetermined direction relative to the attachment surface and located at the predetermined position relative to the attachment surface.

* * * * *